US006386211B1

(12) United States Patent
Smith

(10) Patent No.: US 6,386,211 B1
(45) Date of Patent: May 14, 2002

(54) ORAL HYGIENE MAINTENANCE SYSTEM

(76) Inventor: Gregorita Smith, 17 Bishop Pine La., El Sobrante, CA (US) 94803

( * ) Notice: Subject to any disclaimer, the term of this patent is extended or adjusted under 35 U.S.C. 154(b) by 0 days.

(21) Appl. No.: 09/876,926

(22) Filed: Jun. 8, 2001

(51) Int. Cl.[7] ..... A45D 44/18; A45D 40/00

(52) U.S. Cl. ..... 132/310; 132/308; 132/309; 132/286

(58) Field of Search ..... 132/310, 308, 132/309, 286, 312, 290; 15/167.1

(56) References Cited

U.S. PATENT DOCUMENTS

| | | | | | |
|---|---|---|---|---|---|
| 390,089 | A | * | 9/1888 | McClelland | 132/286 |
| 1,512,981 | A | * | 10/1924 | Gordon | 132/286 |
| 1,657,312 | A | * | 1/1928 | McEldowney | 132/286 |
| 1,683,851 | A | * | 9/1928 | Wells | 132/286 |
| 1,780,757 | A | * | 11/1930 | Lawson et al. | 132/286 |
| 1,790,962 | A | * | 2/1931 | Westing | |
| 1,900,609 | A | * | 3/1933 | McDonough | 132/286 |
| 2,411,196 | A | * | 11/1946 | Doland | 132/286 |
| 4,237,911 | A | | 12/1980 | White | |
| 4,979,525 | A | * | 12/1990 | Chiou | 132/286 |
| 5,054,149 | A | | 10/1991 | Si-Hoe et al. | |
| 5,095,924 | A | | 3/1992 | Stanfield | |
| 5,215,193 | A | * | 6/1993 | Dennis | 206/223 |
| 5,328,682 | A | | 7/1994 | Pullen et al. | |
| 5,713,492 | A | | 2/1998 | Degennaro | |
| 5,738,122 | A | * | 4/1998 | Armbruster et al. | 132/290 |
| D416,387 | S | | 11/1999 | Adams | |
| 6,092,252 | A | * | 7/2000 | Fischer et al. | 15/22.1 |
| 6,220,253 | B1 | * | 4/2001 | Wright | 132/310 |

* cited by examiner

*Primary Examiner*—John J. Wilson
*Assistant Examiner*—Robyn Kieu Doan

(57) ABSTRACT

An oral hygiene maintenance system for allowing a user to brush their teeth without needing water. The oral hygiene maintenance system includes a housing that has a plurality of walls for defining an interior space. The interior space has an upper opening that permits selective access to the interior space of the housing. A cover member is removably couplable to the housing such that the cover is for closing the upper opening of the interior space of the housing. A plurality of oral hygiene devices is removably insertable into the interior space of the housing. Each of the oral hygiene devices is adapted for aiding a user to maintain oral hygiene.

9 Claims, 2 Drawing Sheets

10
12
14
16
18
20
22
24
26
28
30
50
52
54
56

ORAL HYGIENE MAINTENANCE SYSTEM

BACKGROUND OF THE INVENTION

1. Field of the Invention

The present invention relates to oral hygiene maintenance systems and more particularly pertains to a new oral hygiene maintenance system for allowing a user to brush clean their teeth without needing water.

2. Description of the Prior Art

The use of oral hygiene maintenance systems is known in the prior art. More specifically, oral hygiene maintenance systems heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 5,095,924; U.S. Pat. No. 5,054,149; U.S. Pat. No. 5,713,492; U.S. Patent No. Des. 416,387; U.S. Pat. No. 5,328,682; and U.S. Patent No. 4,237,911.

While these devices fulfill their respective, particular objectives and requirements, the aforementioned patents do not disclose a new oral hygiene maintenance system. The inventive device includes a housing that has a plurality of walls for defining an interior space. The interior space has an upper opening that permits selective access to the interior space of the housing. A cover member is removably couplable to the housing such that the cover is for closing the upper opening of the interior space of the housing. A plurality of oral hygiene devices is removably insertable into the interior space of the housing. Each of the oral hygiene devices is adapted for aiding a user to maintain oral hygiene.

In these respects, the oral hygiene maintenance system according to the present invention substantially departs from the conventional concepts and designs of the prior art, and in so doing provides an apparatus primarily developed for the purpose of for allowing a user to brush clean their teeth without needing water.

SUMMARY OF THE INVENTION

In view of the foregoing disadvantages inherent in the known types of oral hygiene maintenance systems now present in the prior art, the present invention provides a new oral hygiene maintenance system construction wherein the same can be utilized for allowing a user to brush clean their teeth without needing water.

The general purpose of the present invention, which will be described subsequently in greater detail, is to provide a new oral hygiene maintenance system apparatus and method which has many of the advantages of the oral hygiene maintenance systems mentioned heretofore and many novel features that result in a new oral hygiene maintenance system which is not anticipated, rendered obvious, suggested, or even implied by any of the prior art oral hygiene maintenance systems, either alone or in any combination thereof.

To attain this, the present invention generally comprises a housing that has a plurality of walls for defining an interior space. The interior space has an upper opening that permits selective access to the interior space of the housing. A cover member is removably couplable to the housing such that the cover is for closing the upper opening of the interior space of the housing. A plurality of oral hygiene devices is removably insertable into the interior space of the housing.

Each of the oral hygiene devices is adapted for aiding a user to maintain oral hygiene.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oral hygiene maintenance system apparatus and method which has many of the advantages of the oral hygiene maintenance systems mentioned heretofore and many novel features that result in a new oral hygiene maintenance system which is not anticipated, rendered obvious, suggested, or even implied by any of the prior art oral hygiene maintenance systems, either alone or in any combination thereof.

It is another object of the present invention to provide a new oral hygiene maintenance system, which may be easily and efficiently manufactured and marketed.

It is a further object of the present invention to provide a new oral hygiene maintenance system, which is of a durable and reliable construction.

An even further object of the present invention is to provide a new oral hygiene maintenance system which is susceptible of a low cost of manufacture with regard to both materials and labor, and which accordingly is then susceptible of low prices of sale to the consuming public, thereby making such oral hygiene maintenance system economically available to the buying public.

Still yet another object of the present invention is to provide a new oral hygiene maintenance system, which provides in the apparatuses and methods of the prior art some of the advantages thereof, while simultaneously overcoming some of the disadvantages normally associated therewith.

Still another object of the present invention is to provide a new oral hygiene maintenance system for allowing a user to brush clean their teeth without needing water.

Yet another object of the present invention is to provide a new oral hygiene maintenance system, which includes a housing that has a plurality of walls for defining an interior space. The interior space has an upper opening that permits selective access to the interior space of the housing. A cover member is removably couplable to the housing such that the cover is for closing the upper opening of the interior space of the housing. A plurality of oral hygiene devices is removably insertable into the interior space of the housing. Each of the oral hygiene devices is adapted for aiding a user to maintain oral hygiene.

Still yet another object of the present invention is to provide a new oral hygiene maintenance system that eliminates the need for a user to purchase and carry separate oral care products.

Even still another object of the present invention is to provide a new oral hygiene maintenance system that is of compact design, saves luggage space while traveling and allows a user to brush their teeth practically anywhere.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
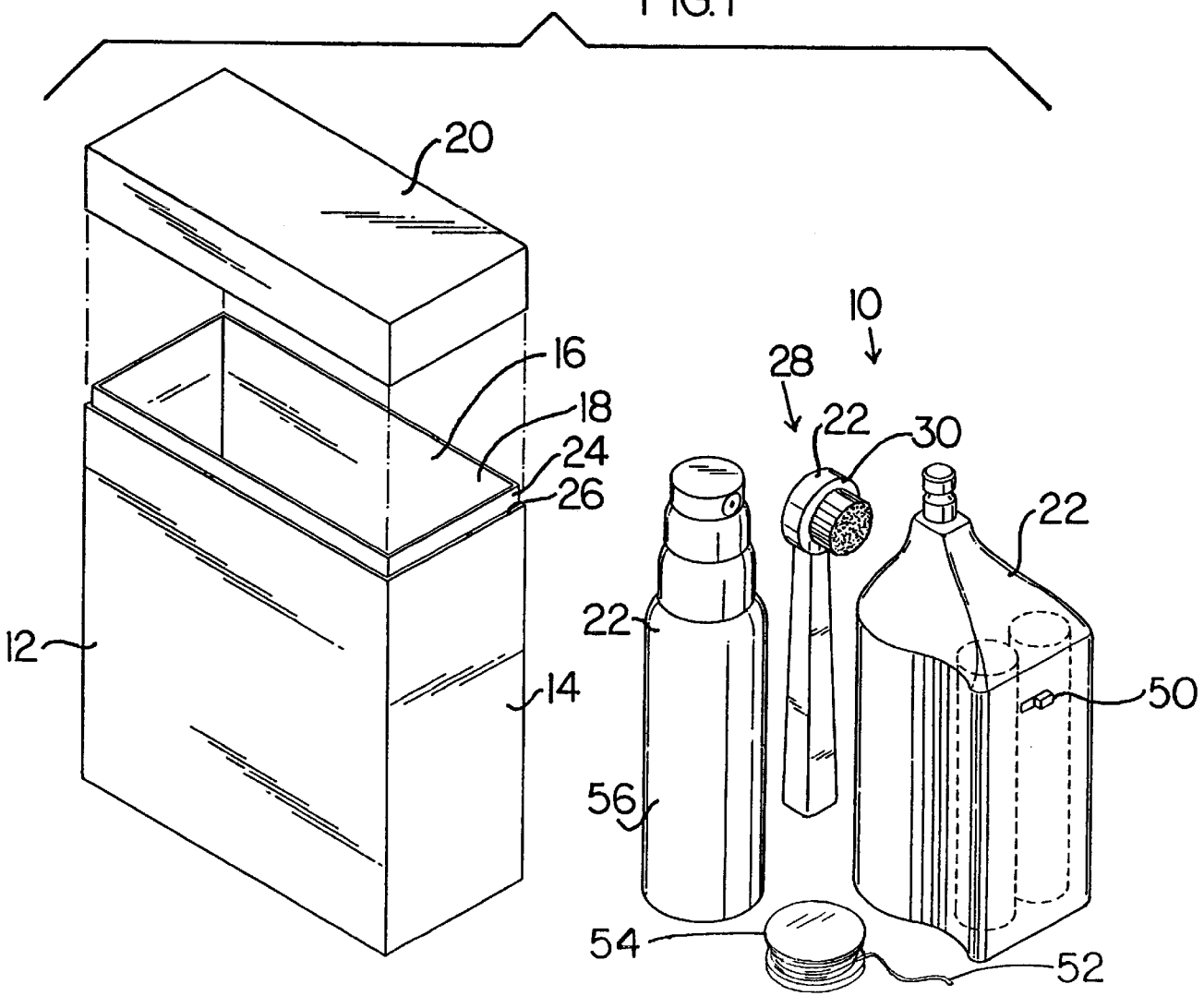
FIG. 1 is a perspective view of a new oral hygiene maintenance system according to the present invention.
Figure 2:
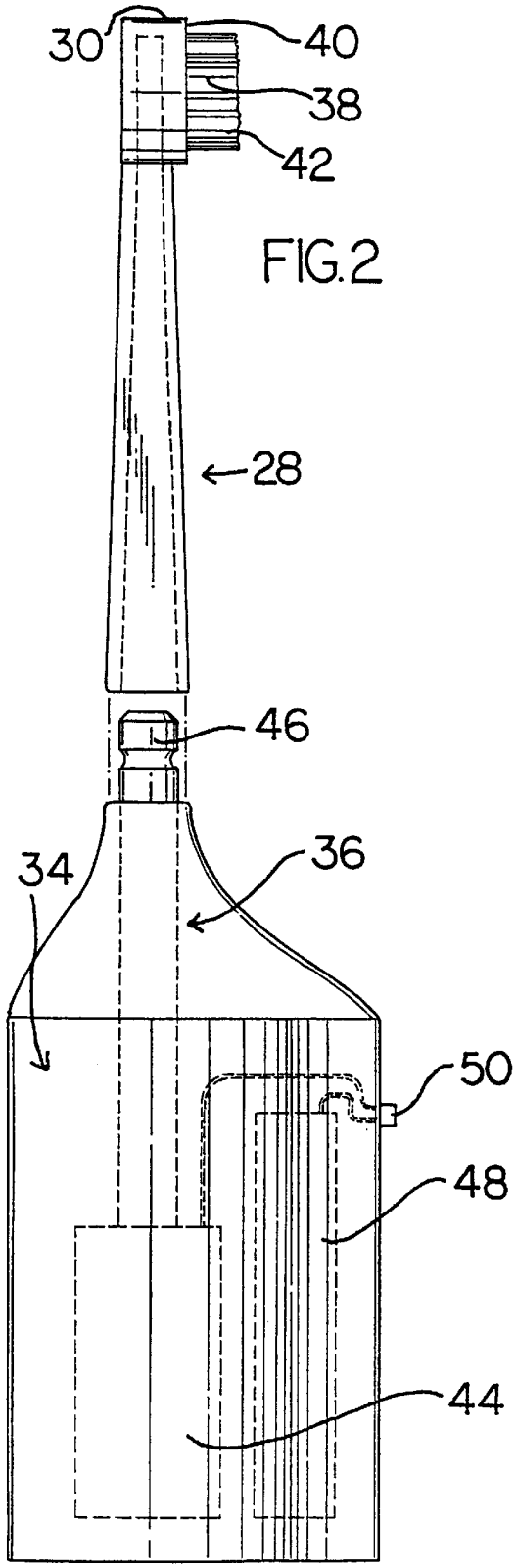
FIG. 2 is a side view of the present invention.
Figure 3:
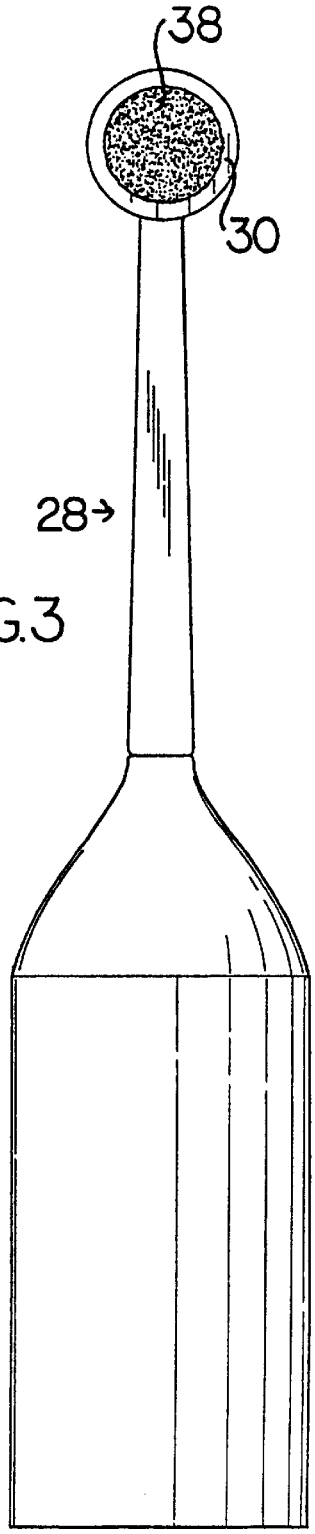
FIG. 3 is a front view of the present invention.

With reference now to the drawings, and in particular to FIGS. 1 through 3 thereof, a new oral hygiene maintenance system embodying the principles and concepts of the present invention and generally designated by the reference numeral 10 will be described.

As best illustrated in FIGS. 1 through 3, the oral hygiene maintenance system 10 generally includes a housing 12 that has a plurality of walls 14 for defining an interior space 16. The interior space 16 has an upper opening 18 that permits selective access to the interior space 16 of the housing 12. A cover member 20 is removably couplable to the housing 12 such that the cover 20 is for closing the upper opening 18 of the interior space 16 of the housing 12. A plurality of oral hygiene devices 22 is removably insertable into the interior space 16 of the housing 12. Each of the oral hygiene devices 22 is adapted for aiding a user to maintain oral hygiene.

The housing 12 has an indexing lip 24 that upwardly extends from a top edge 26 of the housing 12. The cover member 20 is for receiving the indexing lip 24 such that the indexing lip 24 is for maintaining alignment of the cover member 20 and the housing 12 when the cover member 20 is coupled to the housing 12.

The plurality of the oral hygiene devices 22 includes a toothbrush assembly 28. The toothbrush assembly 28 is adapted for selectively brushing teeth of the user. The toothbrush assembly 28 has a head portion 30 and a base portion 32. The head portion 30 is selectively couplable to the base portion 32 such that the base portion 32 and the head portion 30 are separately insertable into the interior space 16 of the housing 12.

The base portion 32 of the toothbrush assembly 28 has a motor assembly 34 that is positioned in the base portion 32. The head portion 30 has a drive assembly 36 that is positioned in the head portion 30. The drive assembly 36 is operationally coupled to a bristle head 38. The bristle head 38 outwardly extends from an upper end 40 of the head portion 30. The motor assembly 34 is operationally coupled to the drive assembly 36 such that the motor assembly 34 is for actuating the drive assembly 36. The drive assembly 36 is for oscillating the bristle head 38 when the drive assembly 36 is actuated by the motor assembly 34. The bristle head 38 has a plurality of bristles 42 that extend from the bristle head 38. The bristles 42 are adapted for cleaning the teeth of the user when the bristle head 38 is oscillated by the drive assembly 36.

The motor assembly 34 has a motor 44. The motor 44 has a shaft 46 that extends from the motor 44. The motor 44 is for actuating the shaft 46. The shaft 46 is for operationally coupling to the drive assembly 36 of the head portion 30 such that actuation of the shaft 46 actuates the drive assembly 36. A power source 48 is operationally coupled to the motor 44 such that the power source 48 is for providing power to the motor 44. The motor assembly 34 has a switch 50. The switch 50 is electrically coupled between the power source 48 and the motor 44. The switch 50 is for controlling power from the power source 48 to the motor 44.

The plurality of oral hygiene devices 22 includes dental floss 52. The dental floss 52 is wound onto a spool 54. The dental floss 52 is adapted for is used by the user for cleaning between the teeth of the user. The plurality of oral hygiene devices 22 includes a dentifrice dispensing bottle 56. The dentifrice dispensing bottle 56 is adapted for holding an amount of dentifrice. The dentifrice dispensing bottle 56 is adapted for dispensing the dentifrice onto the head portion 30 of the toothbrush assembly 28 for facilitating maintaining oral hygiene of the user.

In use, a user a user would brush their teeth with the battery powered tooth brush, floss their teeth with the included dental floss and rinse with the included mouth wash spray dispensing bottle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An oral hygiene maintenance system comprising:

a housing having a plurality of walls defining an interior space, said interior space having an upper opening permitting selective access to said interior space of said housing, a cover member being removably couplable to said housing such that said cover is for closing said upper opening of said interior space of said housing;

a plurality of oral hygiene devices being removably insertable into said interior space of said housing, each of said oral hygiene devices being adapted for aiding a user to maintain oral hygiene; and said plurality of said oral hygiene devices including a tooth brush assembly, said tooth brush assembly being adapted for selectively brushing teeth of the user, said tooth brush assembly having a head portion and a base portion, said head portion being selectively couplable to said base portion such that said base portion and said head portion are separately insertable into said interior space of said housing, said base portion of said tooth brush assembly having a pair of depressions, each of said depressions extending along a portion of a length of said base portion, one of said depressions being positioned opposite the other of said depressions such that said depressions are adapted for receiving finger tips of a hand of the user for inhibiting slipping of said base portion from the hand of the user when the user is brushing.

2. The oral hygiene maintenance system as set forth in claim 1, further comprising:

said housing having an indexing lip upwardly extending from a top edge of said housing, said cover member being for receiving said indexing lip such that said indexing lip is for maintaining alignment of said cover member and said housing when said cover member is coupled to said housing.

3. The oral hygiene maintenance system as set forth in claim 1, further comprising:

said base portion of said tooth brush assembly having a motor assembly being positioned in said base portion, said head portion having a drive assembly being positioned in said head portion, said drive assembly being operationally coupled to a bristle head, said bristle head outwardly extending from an upper end of said head portion, said motor assembly being operationally coupled to said drive assembly such that said motor assembly is for actuating said drive assembly, said drive assembly being for oscillating said bristle head when said drive assembly is actuated by said motor assembly.

4. The oral hygiene maintenance system as set forth in claim 3, further comprising:

said bristle head having a plurality of bristles extending from said bristle, said bristles being adapted for cleaning the teeth of the user when said bristle head is oscillated by said drive assembly.

5. The oral hygiene maintenance system as set forth in claim 3, further comprising:

said motor assembly having a motor, said motor having a shaft extending from said motor, said motor being for actuating said shaft, said shaft being for operationally coupling to said drive assembly of said head portion such that actuation of said shaft actuates said drive assembly, a power source being operationally coupled to said motor such that said power supply is for providing power to said motor.

6. The oral hygiene maintenance system as set forth in claim 5, further comprising:

said motor assembly having a switch, said switch being operationally coupled between said power supply and said motor, said switch being for controlling power from said power supply to said motor.

7. The oral hygiene maintenance system as set forth in claim 1, further comprising:

said plurality of oral hygiene devices including dental floss, said dental floss being wound onto a spool, said dental floss being adapted for being used by the user for cleaning between the teeth of the user.

8. The oral hygiene maintenance system as set forth in claim 1, further comprising:

said plurality of oral hygiene devices including a dentifrice dispensing bottle, said dentifrice dispensing bottle being adapted for holding an amount of dentifrice, said dentifrice dispensing bottle being adapted for dispensing the dentifrice onto said head portion of said tooth brush assembly for facilitating maintaining oral hygiene of the user.

9. An oral hygiene maintenance system comprising:

a housing having a plurality of walls defining an interior space, said interior space having an upper opening permitting selective access to said interior space of said housing, a cover member being removably couplable to said housing such that said cover is for closing said upper opening of said interior space of said housing;

a plurality of oral hygiene devices being removably insertable into said interior space of said housing, each of said oral hygiene devices being adapted for aiding a user to maintain oral hygiene;

wherein said housing having an indexing lip upwardly extending from a top edge of said housing, said cover member being for receiving said indexing lip such that said indexing lip is for maintaining alignment of said cover member and said housing when said cover member is coupled to said housing;

wherein said plurality of said oral hygiene devices including a tooth brush assembly, said tooth brush assembly being adapted for selectively brushing teeth of the user, said tooth brush assembly having a head portion and a base portion, said head portion being selectively couplable to said base portion such that said base portion and said head portion are separately insertable into said interior space of said housing, said base portion of said tooth brush assembly having a pair of depressions, each of said depressions extending along a portion of a length of said base portion, one of said depressions being positioned opposite the other of said depressions such that said depressions are adapted for receiving finger tips of a hand of the user for inhibiting slipping of said base portion from the hand of the user when the user is brushing;

wherein said base portion of said tooth brush assembly having a motor assembly being positioned in said base portion, said head portion having a drive assembly being positioned in said head portion, said drive assembly being operationally coupled to a bristle head, said bristle head outwardly extending from an upper end of said head portion, said motor assembly being operationally coupled to said drive assembly such that said motor assembly is for actuating said drive assembly, said drive assembly being for oscillating said bristle head when said drive assembly is actuated by said motor assembly;

wherein said bristle head having a plurality of bristles extending from said bristle, said bristles being adapted for cleaning the teeth of the user when said bristle head is oscillated by said drive assembly;

wherein said motor assembly having a motor, said motor having a shaft extending from said motor, said motor being for actuating said shaft, said shaft being for operationally coupling to said drive assembly of said head portion such that actuation of said shaft actuates said drive assembly, a power source being operationally coupled to said motor such that said power supply is for providing power to said motor;

wherein said motor assembly having a switch, said switch being operationally coupled between said power supply and said motor, said switch being for controlling power from said power supply to said motor;

wherein said plurality of oral hygiene devices including dental floss, said dental floss being wound onto a spool, said dental floss being adapted for being used by the user for cleaning between the teeth of the user;

wherein said plurality of oral hygiene devices including a dentifrice dispensing bottle, said dentifrice dispensing bottle being adapted for holding an amount of dentifrice, said dentifrice dispensing bottle being adapted for dispensing the dentifrice onto said head portion of said tooth brush assembly for facilitating maintaining oral hygiene of the user.

* * * * *